US006896165B1

(12) United States Patent
Wang

(10) Patent No.: US 6,896,165 B1
(45) Date of Patent: May 24, 2005

(54) DEVICE FOR PREVENTING SHORT NAILS OF A NAIL GUN FROM BEING DEADLOCKED

(75) Inventor: Brian Wang, Fenyuan Shiang Changhua (TW)

(73) Assignee: Bentley Fastening Tools Co., Ltd., Taichung (TW)

( * ) Notice: Subject to any disclaimer, the term of this patent is extended or adjusted under 35 U.S.C. 154(b) by 0 days.

(21) Appl. No.: 10/805,349

(22) Filed: Mar. 22, 2004

(51) Int. Cl.[7] ..... B27F 7/00

(52) U.S. Cl. ..... 227/109; 227/119; 227/136; 227/120

(58) Field of Search ..... 227/107, 109, 227/119, 120, 136

(56) References Cited

U.S. PATENT DOCUMENTS 3,589,586 A * 6/1971 Mazzer ..... 227/130
3,980,179 A * 9/1976 Schrepferman ..... 206/338
4,139,136 A * 2/1979 Catalano ..... 227/109
4,174,802 A * 11/1979 Maestri ..... 227/109
4,253,598 A * 3/1981 Haytayan ..... 227/119
4,858,811 A * 8/1989 Brosius et al. ..... 227/10
5,240,161 A * 8/1993 Kaneko ..... 227/109
5,816,469 A * 10/1998 Ohuchi ..... 227/119
6,076,721 A * 6/2000 Yang ..... 227/120
6,398,097 B1 * 6/2002 Liang ..... 227/109
6,502,737 B2 * 1/2003 Akiba ..... 227/109
6,557,743 B2 * 5/2003 Schuster ..... 227/109
D486,712 S * 2/2004 Yao ..... D8/68
2001/0025871 A1 * 10/2001 Losada

* cited by examiner

*Primary Examiner*—Scott A. Smith
*Assistant Examiner*—Brian Nash
(74) *Attorney, Agent, or Firm*—Troxell Law Office, PLLC

(57) ABSTRACT

A device for preventing short nails of a nailing gun from being deadlocked includes a slot-sealing member provided under the gunpoint of a nailing gun. The slot sealing member has its topside formed with an elongate slot sealing portion for sealing up the front slot of the nail row inlet of the gunpoint when the slot sealing member is pushed inward, preventing a short nail from being deadlocked when it is struck in a work. When the slot sealing member is pushed outward, its sealing portion will be moved away from the front slot of the nail inlet to completely open the nail row inlet for facilitating loading a long nail formed in a row in the gunpoint, unnecessary to disassemble the slot sealing member from the gunpoint when a row of long nails and short nails are loaded alternately, and easy and quick in operating.

2 Claims, 10 Drawing Sheets

DEVICE FOR PREVENTING SHORT NAILS OF A NAIL GUN FROM BEING DEADLOCKED

BACKGROUND OF THE INVENTION

1. Field of the Invention

This invention relates to a device for preventing short nails of a nailing gun from being deadlocked, particularly to one provided under the gunpoint of a nail gun and adjustable to be moved transversely for sealing up the front slot of the nail row inlet under the gunpoint. Thus, when a nailing gun is loaded with short nail rows for use, the short nails can avoid being deadlocked.

2. Description of the Prior Art

The nail cartridge of a conventional nail gun usually has its front wall bored with an insert groove for the lower end of a long nail formed in a row to extend therethrough so that the long nail can be pushed in the gunpoint through the nail outlet in the topside of the nail cartridge. Further, the gunpoint has its lower side bored with a nail inlet facing the nail outlet of the nail cartridge and longer than the long nail for the long nail to be loaded therein. Therefore, part of the front portion of the nail inlet of the gunpoint exceeds the front edge of the nail cartridge and forms an unclosed slot, which always renders a short nail liable to be deadlocked during nail striking. In view of this drawback, a slot-sealing member 10 is provided to prevent short nails from being deadlocked. The slot-sealing member 10, as shown in FIGS. 1, 2 and 3, is an inverted L-shaped vertical plate 11 consisting of a vertical portion 111 and a horizontal portion 112. The vertical portion 111 is to be inserted in the front insert groove 211 of the nail cartridge 21 of a nail gun 20, having a position hole 113 for a locking bolt 114 to be inserted therethrough and locked in the insert holes 212 in the opposite side walls of the nail cartridge 21. The horizontal portion 112 is to be inserted in the front slot 222 of the nail row inlet 221 under the gunpoint 22 for sealing up the slot 222, having its upper sealing surface 115 positioned flush with the nail guiding surface 223 of the gunpoint 22 so as to guide the nail row 23 to slide forward smoothly. In addition, the vertical portion 111 has its front end formed with a transverse plate 12 to be positioned on the front wall of the nail cartridge 21. Thus, when the nail gun 20 is loaded with a row of short nail 23 for use, the slot sealing member 10 can be assembled with the nail cartridge 21 to seal up the slot 222, preventing short nails from being deadlocked.

When the nail gun 20 is loaded with a short nail 23 for use, the slot sealing member 10 has to be assembled with the nail cartridge 21, but when a row of long nails 23 is used, the slot sealing member 10 must be disassembled from the nail cartridge 21 so as not to block the lower end of a long nail 23, inconvenient in replacing a row of long nails and a row of short nail alternately and likely to drop or lose the slot sealing member 20 after the slot sealing member 20 is completely detached.

SUMMARY OF THE INVENTION

The objective of the invention is to offer a device for preventing short nails of a nail gun from being deadlocked, which is provided with a slot-sealing member. The slot sealing member includes an upper elongate slot sealing portion having one side near its intermediate section provided with a connect portion extending downward vertically and then extending outward horizontally to form a pivotal portion with a long sliding groove. An adjusting bolt is inserted through the long sliding groove and then screwed with a threaded hole in one side of the lower portion of the gunpoint of a nail gun, able to be adjusted to permit the slot sealing member to shift transversely for sealing or unsealing the front slot of the nail inlet of the gunpoint.

The slot sealing member of this invention can be adjusted to shift transversely for sealing or unsealing the front slot of the nail row inlet of the gunpoint, applicable to loading of rows of short or long nails, able to prevent short nails from being deadlocked, and easy and quick in operating.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
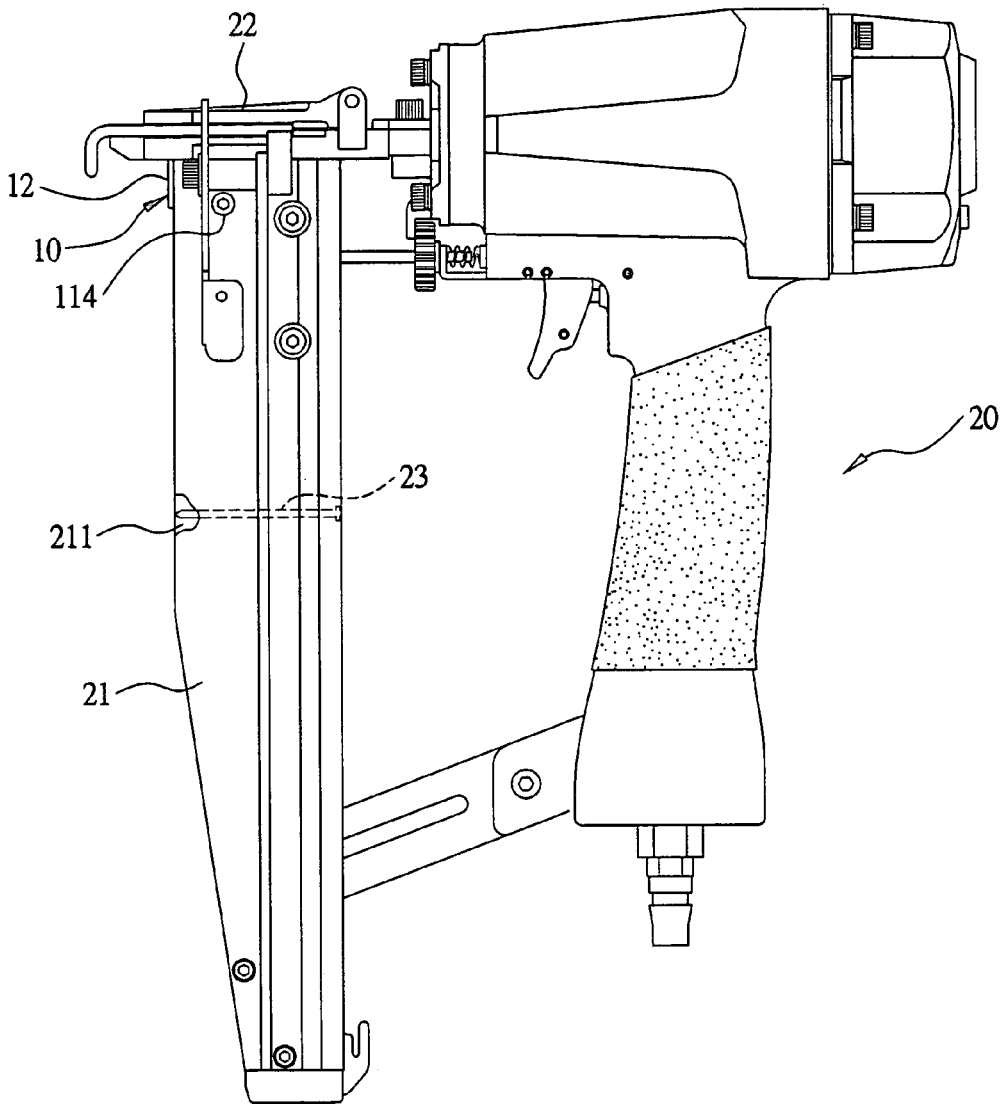
FIG. 1 PRIOR ART
FIG. 1 is a partial cross-sectional view of a conventional nailing gun.
Figure 2:
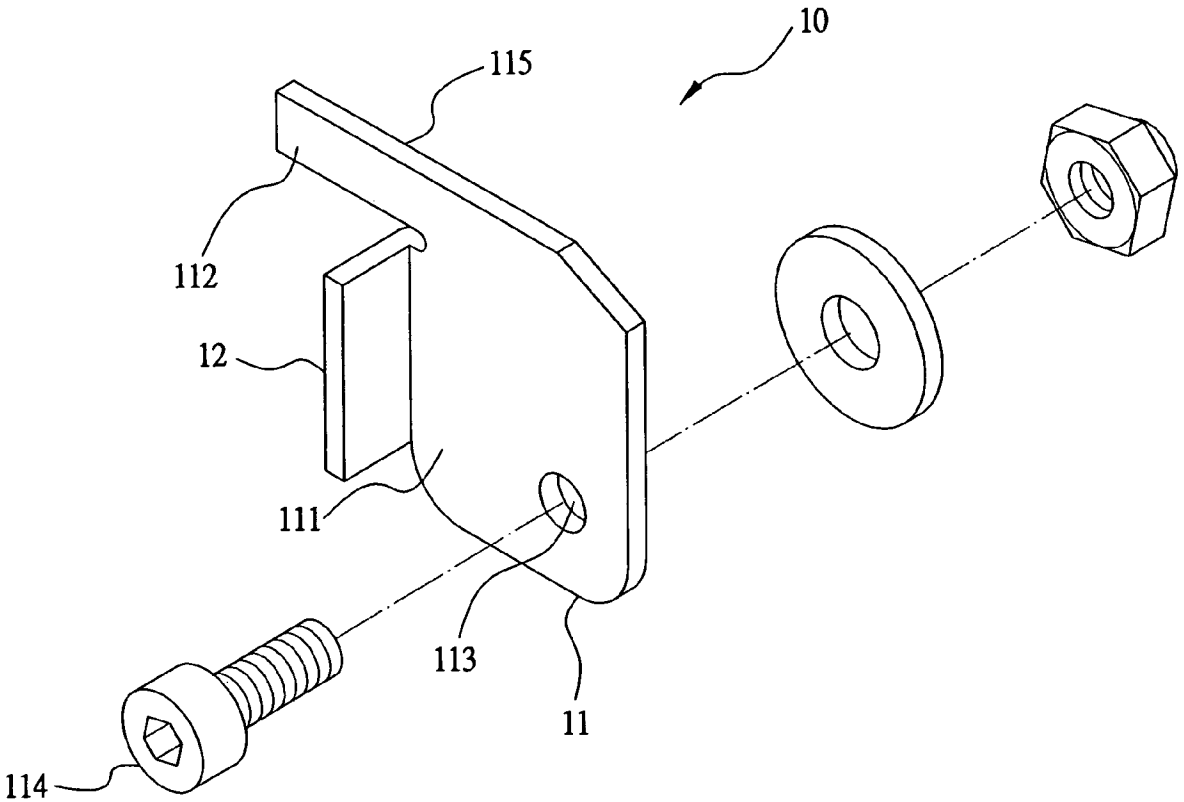
FIG. 2 PRIOR ART
FIG. 2 is an exploded perspective view of a conventional slot-sealing member in the conventional nail gun.
Figure 3:
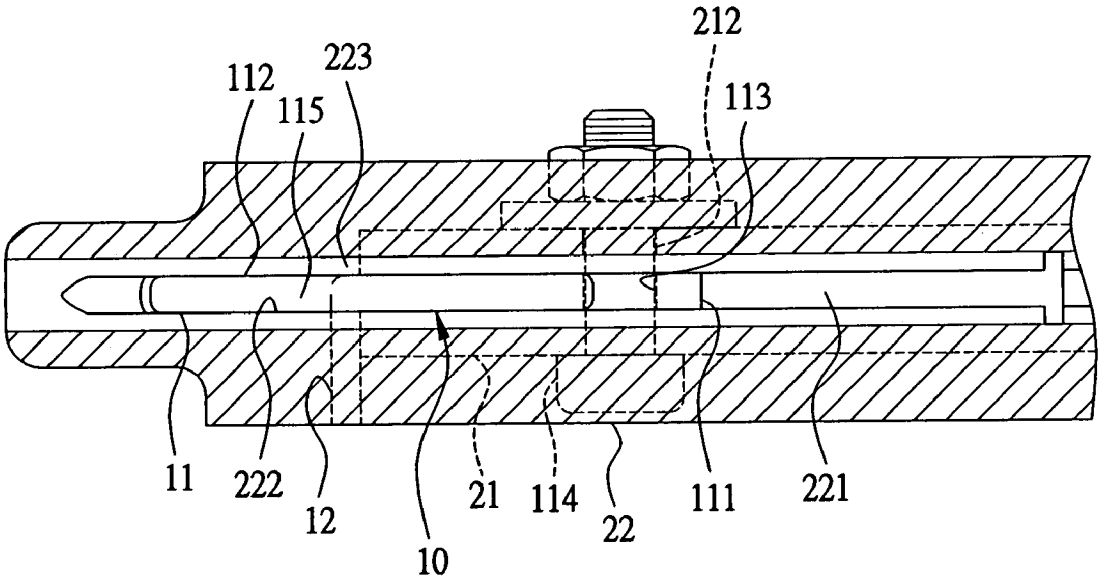
FIG. 3 PRIOR ART
FIG. 3 is a partial upper cross-sectional view of the conventional slot-sealing member assembled with a nail cartridge.
Figure 4:
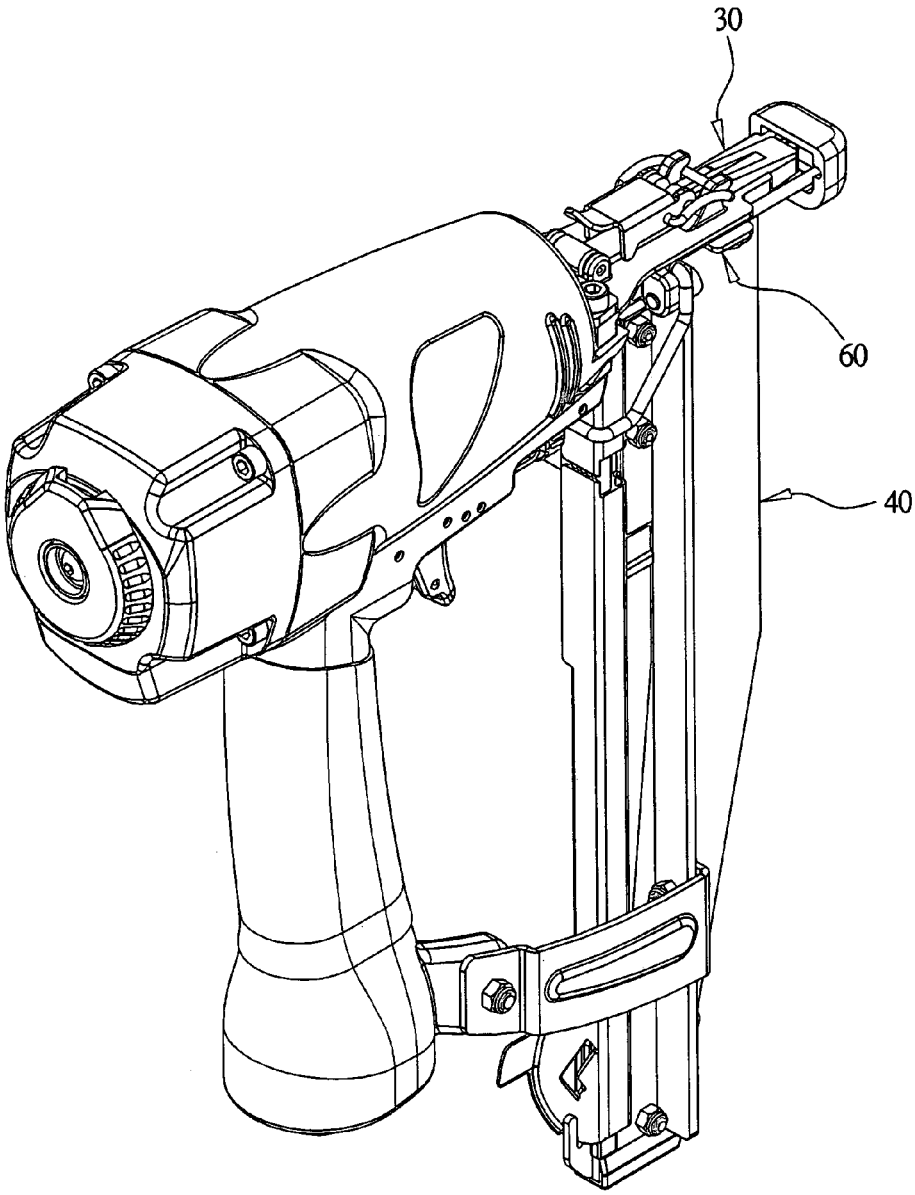
FIG. 4 is a perspective view of a nail gun in the present invention.
Figure 5:
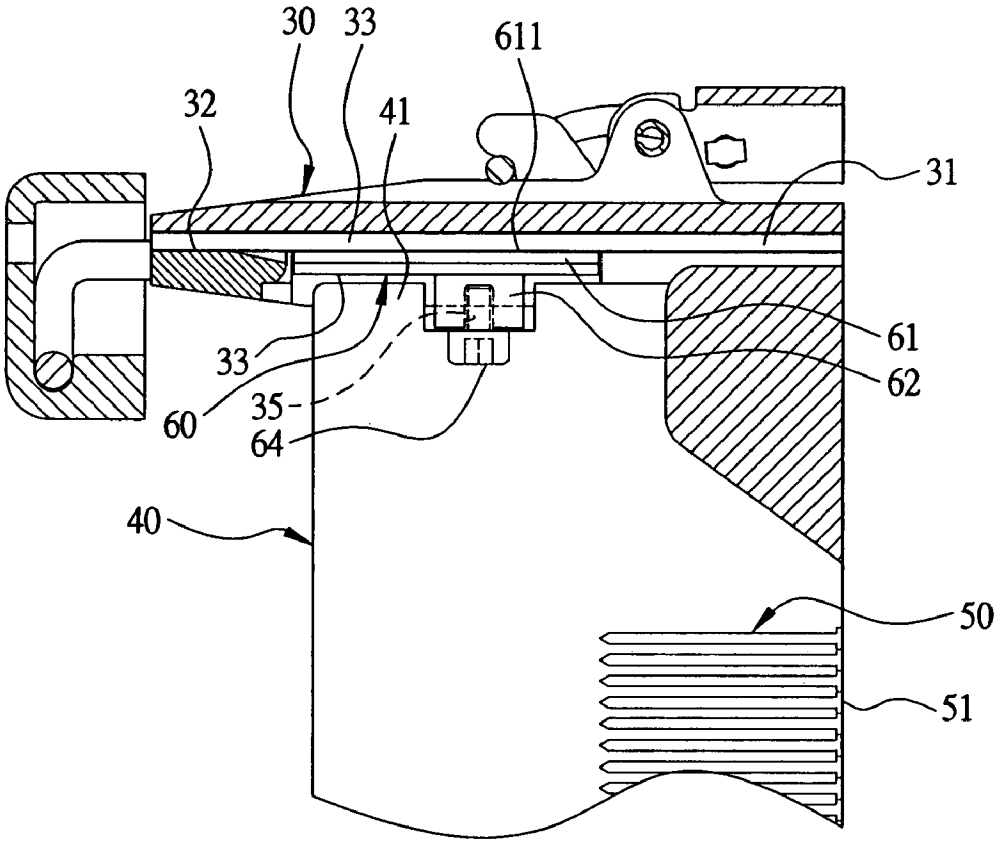
FIG. 5 is a partial side cross-sectional view of a slot-sealing member in an assembled condition in the present invention.
Figure 6:
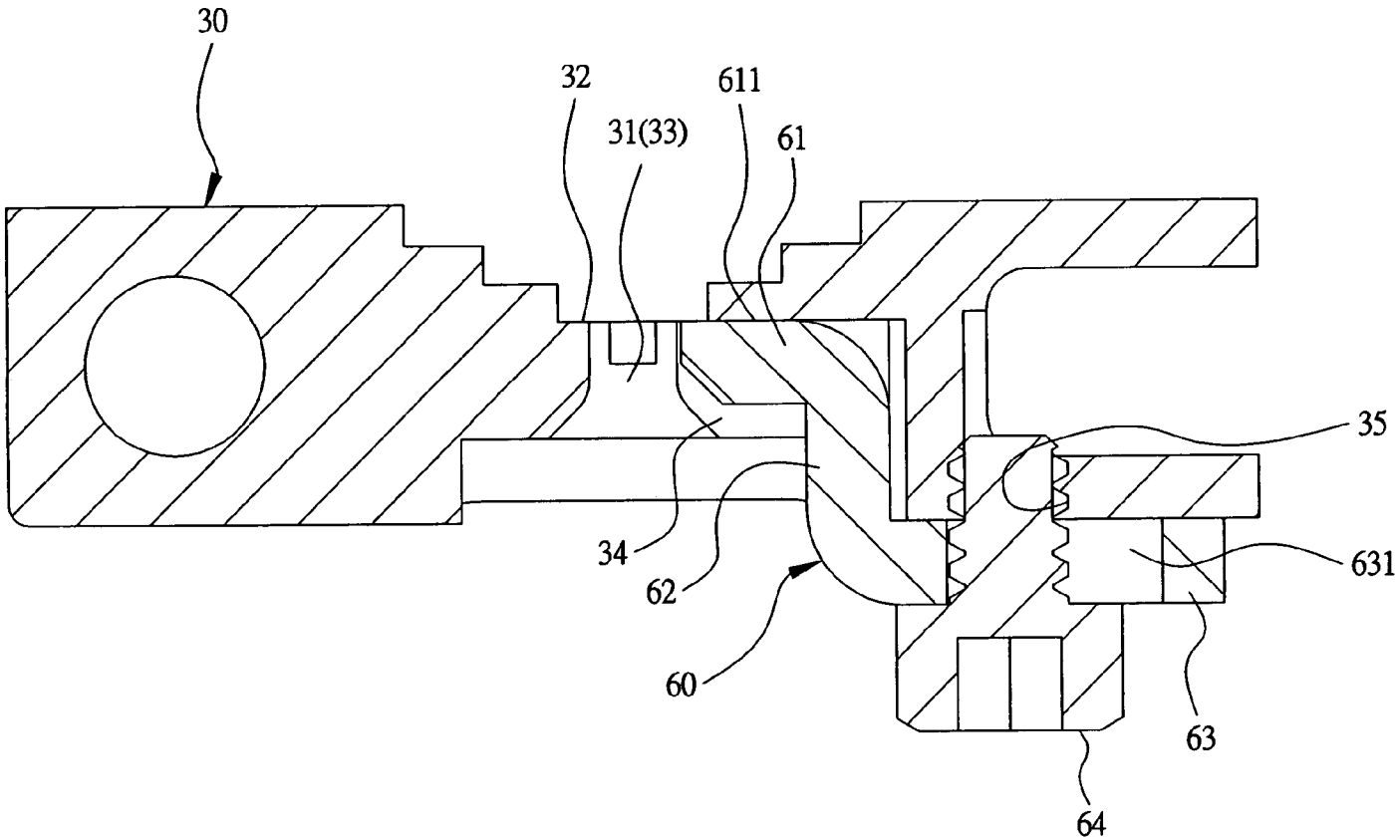
FIG. 6 is a partial rear cross-sectional view of the slot-sealing member in an assembled condition in the present invention.

A preferred embodiment of a device for preventing short nails of a nailing gun from being deadlocked in the present invention, as shown in FIGS. 4, 5 and 6, includes a nailing gun, a nail cartridge 40 and a slot sealing member 60, having almost the same structure as the conventional one described above.

The nail gun has its front end formed with a gunpoint 30 having its lower side bored with a nail inlet 31 and its interior transversely provided with a nail guiding surface 32 communicating with the nail inlet 31.

The nail cartridge 40 having a nail outlet 41 in the topside is assembled under the nail inlet 31 of the gunpoint 30 for a nail 50 of a nail row to be loaded therein in a way to let nail heads 51 slide up. The nail inlet 31 has its front part exceeding the nail outlet 41 by a certain distance and forming a slot 33 to enable a long nail 50 of a nail row of the nail cartridge 40 to be loaded in the gunpoint 30 for use through the nail outlet 41 of the nail cartridge 40 and the nail inlet 31 of the gunpoint 30.

The gun point 30 has one side transversely bored at a preset location with an accommodating groove 34 having its topside flush with the nail guiding surface 32 of the gunpoint 30 and its lower side bored with a threaded hole 35 at a preset location of the same side of the accommodating groove 34.

Figure 8:
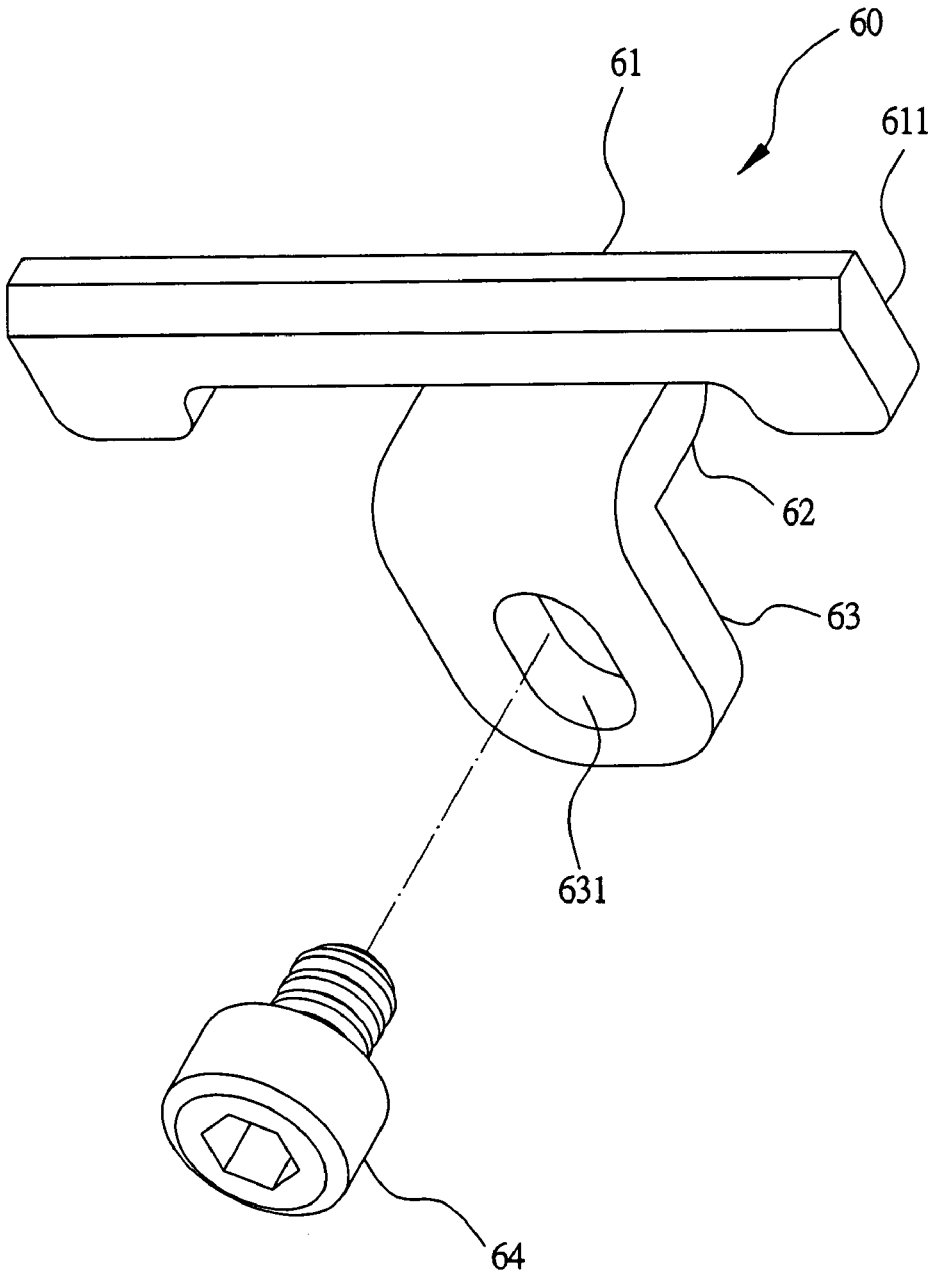
FIG. 8 is an exploded perspective view of the slot-sealing member in the present invention.

The slot sealing member 60, as shown in FIG. 8, has its topside formed with an elongate slot sealing portion 61 able to be exactly received in the accommodating groove 34 of the gunpoint 30 and having the upper side formed with a sealing surface 611 flush with the nail guiding surface 32 of the gunpoint 30 for duly sealing up the front slot 33 of the nail inlet 31 of the gunpoint 30. In addition, the sealing portion 61 has the outer side near its intermediate section provided with a vertical connect portion 62 extending downward and then extending horizontally to form a pivotal portion 63 having a long sliding groove 631 positioned beneath the threaded hole 35 of the gunpoint 30. An adjusting bolt 64 is inserted through the long sliding groove 631 and screwed with the threaded hole 35 of the gunpoint 30, adjustable in tightness to enable the slot sealing member 60 to slide transversely to move away from or seal up the front slot 33 of the nail inlet 31 of the gunpoint 30.

The nailing gun in the present invention is provided with the slot sealing member 60 under its gunpoint 30 so its nail cartridge 40 can be loaded with a row of long nails 50 or of short nails 50 for use. Loading of a long nail row 50 or a short nail row 50 in the nail cartridge 40 for use is described as follows.

Figure 7:
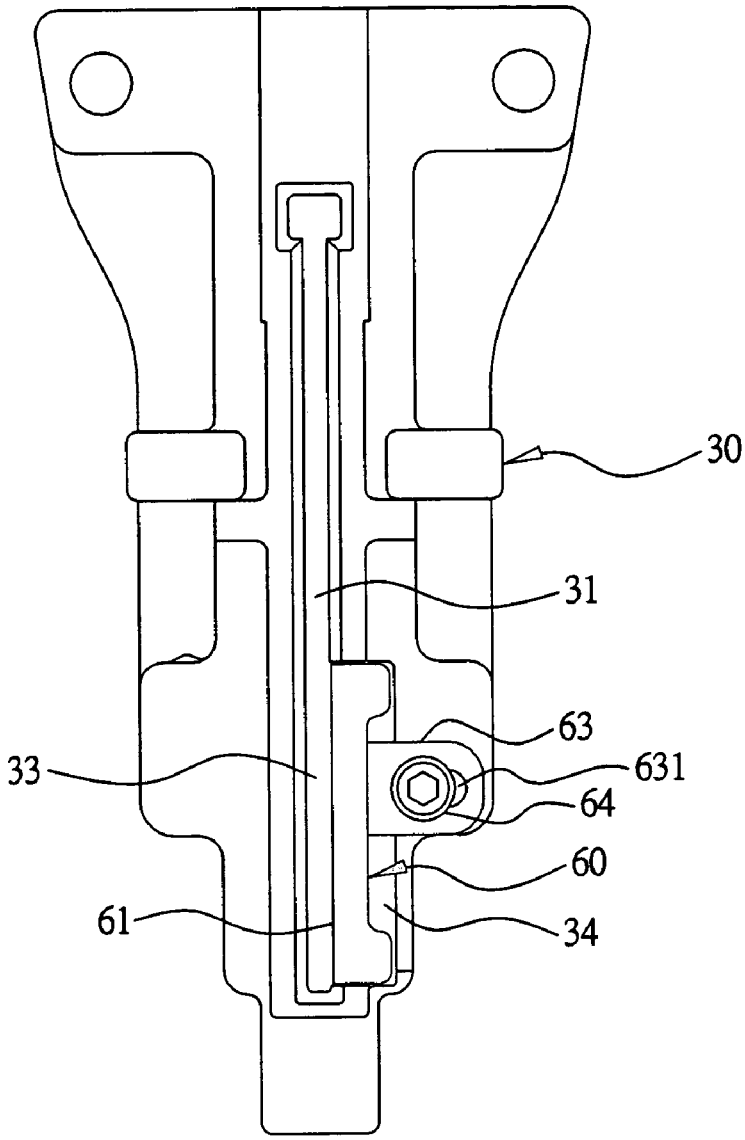
FIG. 7 is an upper view of the slot-sealing member in an assembled condition in the present invention.

1. Loading of a row of long nails 50 for use: As shown in FIGS. 6 and 7, if the front slot 33 of the nail inlet 31 of the gunpoint 30 is sealed up by the slot sealing portion 61 of the slot sealing member 60, the adjusting bolt 64 on the slot sealing member 60 is properly unscrewed first, and the slot sealing member 60 is pushed outward to move its slot sealing portion 61 away from the slot 33 of the gunpoint 30 and then adjusting bolt 64 is screwed tight again. At this time, the nail outlet 41 of the nail cartridge 40 is completely open so the long nails in the nail cartridge 40 can smoothly be pushed in the gunpoint 30 through the nail inlet 31.

Figure 9:
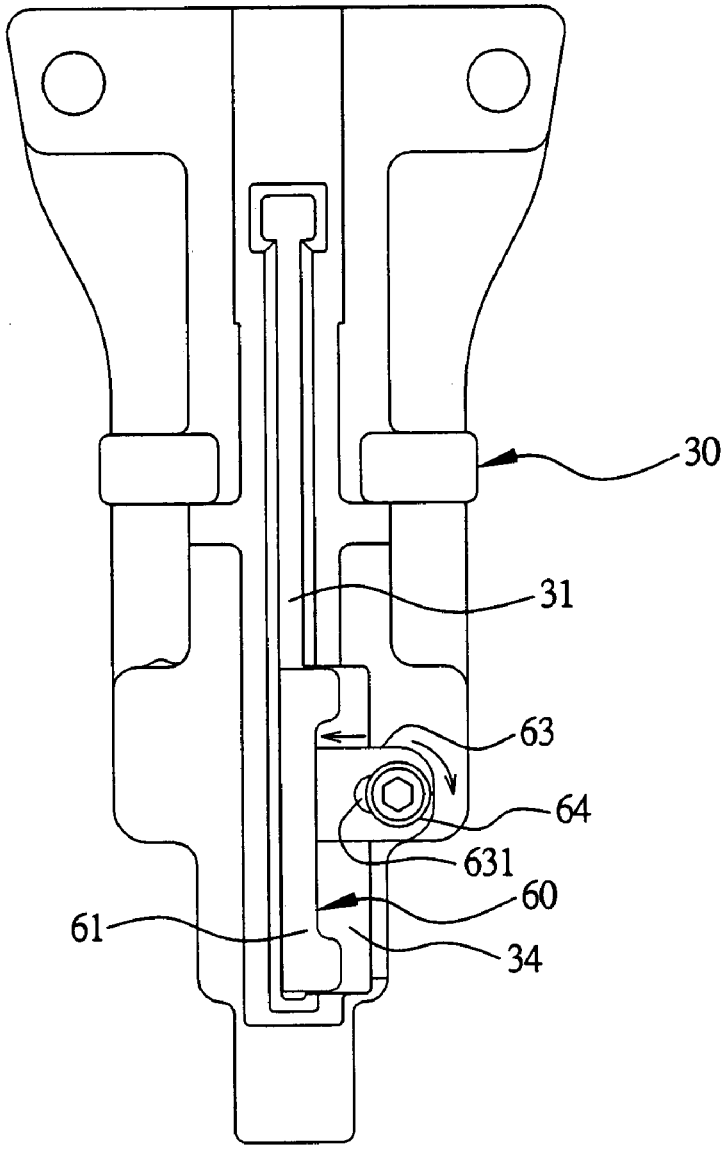
FIG. 9 is an upper view of the slot sealing member adjusted for loading a short nail formed in a row in a nail cartridge for use in the present invention.
Figure 10:
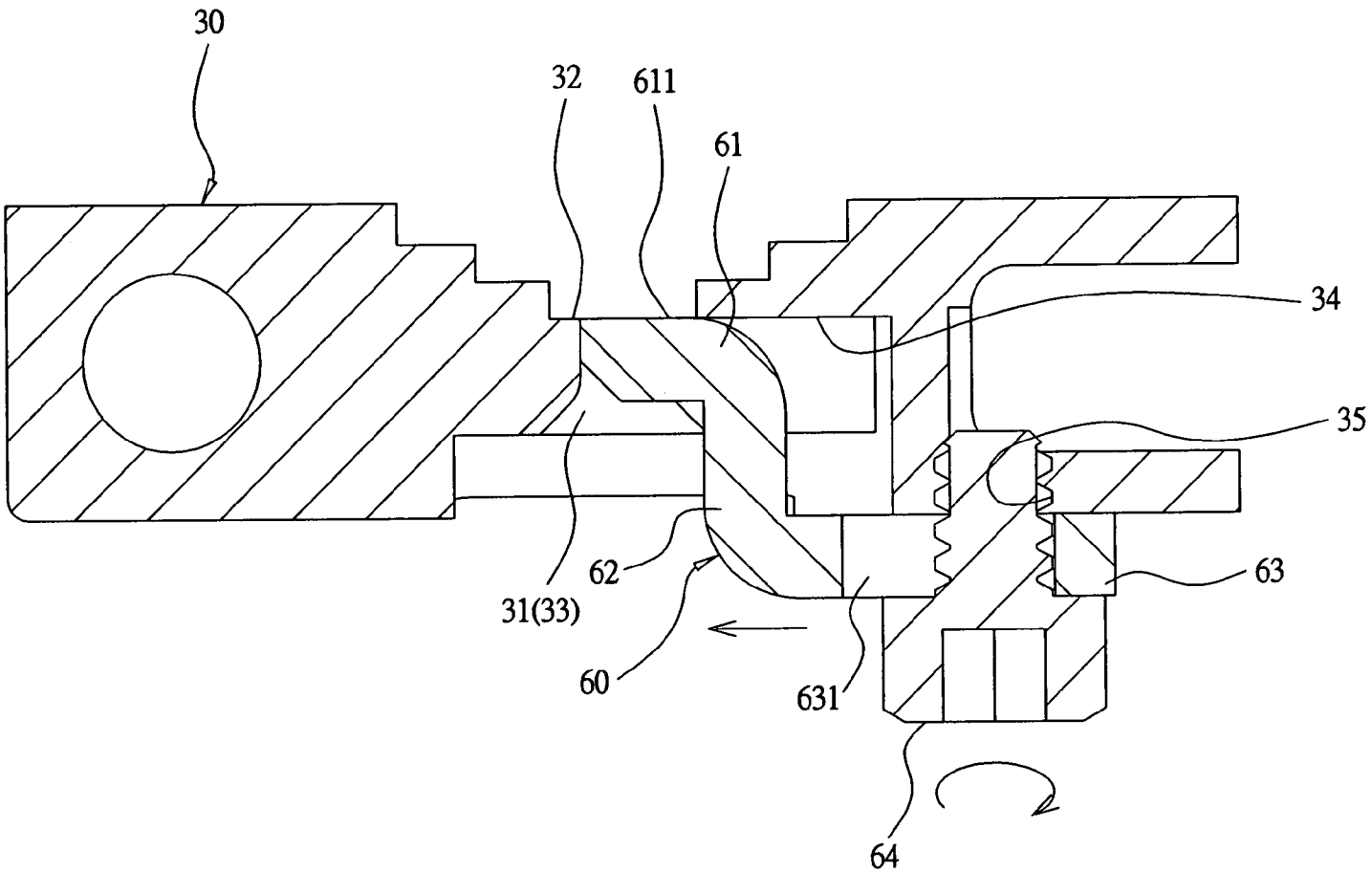
FIG. 10 is a rear cross-sectional view of the slot-sealing member adjusted for loading a short nail formed in a row in a nail cartridge for use in the present invention.

2. Loading of a row of short nails 50 for use: As shown in FIGS. 9 and 10, the adjusting bolt 64 on the slot sealing member 60 is properly unscrewed and the slot sealing member 60 is pushed inward to let its slot sealing portion 61 exactly seal up the front slot 33 of the nail row inlet 31 of the gunpoint 30, and then the adjusting bolt 64 is screwed tight again. Thus, when a short nail 50 formed in a row in the nail cartridge 40 is pushed out from the nail outlet 41 and loaded in the gunpoint 30 through the rear slot of the nail inlet 31 to be struck for use, the short nail can only move forward along the nail guiding surface 32 of the gunpoint 30 and the slot sealing surface 611, which is flush with the nail guiding surface 32, on the sealing portion 61 of the slot sealing member 60, preventing a short nail from moving outward through the front slot 33 of the nail inlet 31 and being deadlocked.

As can be understood from the above description, this invention has the following advantages.

1. The slot sealing member provided under the gunpoint is able to duly seal up the front slot of the nail inlet of the gunpoint; therefore, when a short nail is struck, it will not move out through the front slot, able to prevent a short nail from being deadlocked.

2. The slot sealing member of this invention can be adjusted and restricted to slide for sealing or unsealing the front slot of the nail row inlet only by unscrewing or screwing of the adjusting bolt, easy and quick in operating.

3. In adjusting, the slot-sealing member is unnecessary to be disassembled from the gunpoint, preventing the slot-sealing member from dropping or being lost after it is detached.

While the preferred embodiment of the invention has been described above, it will be recognized and understood that various modifications may be made therein and the appended claims are intended to cover all such modifications that may fall within the spirit and scope of the invention.

I claim:

1. A device for preventing short nails of a nail gun from being deadlocked comprising:

a) a nail cartridge having a nail outlet;

b) a gun point located on a front of the nail gun and having:

i) a nail inlet bored therein and communicating with the nail outlet, the nail inlet having a slot located on a front portion thereof;

ii) a nail guiding surface located on a periphery of the nail inlet; and iii) an accommodating groove communicating with the nail inlet; and c) a slot sealing member having:

i) an elongated slot sealing portion inserted into the accommodating groove and having a sealing surface located flush with the nail guiding surface, the elongated slot sealing portion being movable between open and closed positions, in the open position the elongated slot sealing portion is removed from the slot of the nail inlet and in the closed position the elongated slot sealing portion is located in the slot of the nail inlet;

ii) a vertical connect portion connected to the elongated slot sealing portion; and iii) a pivotal portion connected to the vertical connect portion and having a sliding groove.

2. The device according to claim 1, further comprising an adjusting bolt inserted through the sliding groove, connected to a threaded hole of the gun point, and selectively locking the slot sealing member in one of the open position and the closed position.

* * * * *